US010197069B2

(12) United States Patent
Leslie et al.

(10) Patent No.: US 10,197,069 B2
(45) Date of Patent: Feb. 5, 2019

(54) OUTER AIRSEAL FOR GAS TURBINE ENGINE

(71) Applicant: United Technologies Corporation, Farmington, CT (US)

(72) Inventors: Nicholas R. Leslie, South Berwick, ME (US); Mark J. Rogers, Kennebunk, ME (US); Philip Robert Rioux, North Berwick, ME (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 363 days.

(21) Appl. No.: 14/947,494

(22) Filed: Nov. 20, 2015

(65) Prior Publication Data

US 2017/0146024 A1 May 25, 2017

(51) Int. Cl.
*F01D 11/08* (2006.01)
*F04D 29/52* (2006.01)
(Continued)

(52) U.S. Cl.
CPC ..... *F04D 29/526* (2013.01); *F01D 11/08* (2013.01); *F01D 11/12* (2013.01); *F01D 11/122* (2013.01);
(Continued)

(58) Field of Classification Search
None
See application file for complete search history.

(56) References Cited

U.S. PATENT DOCUMENTS 3,825,364 A * 7/1974 Halila ..... F01D 11/12 165/907
4,468,168 A * 8/1984 Aubert ..... F01D 11/08 415/116

(Continued)

FOREIGN PATENT DOCUMENTS

EP 1001140 A2 5/2000
WO 2014168804 A1 10/2014
WO 2015102702 A2 7/2015

OTHER PUBLICATIONS

European Search Report and Written Opinion; International Application No. 16195658.6; International Filing Date: Oct. 26, 2016; dated Apr. 6, 2017; 7 pages.

*Primary Examiner* — Igor Kershteyn
*Assistant Examiner* — Theodore Ribadeneyra
(74) *Attorney, Agent, or Firm* — Cantor Colburn LLP

(57) ABSTRACT

An airseal for sealing between a rotating component and a stationary component of a turbine engine includes a sealing surface defining a spacing between the airseal and a rotating component of the turbine engine and a mounting flange to secure the airseal to a stationary component of the turbine engine. An airseal body extends between the sealing surface and the mounting flange. The airseal body includes a cavity configured to absorb thermal energy transferred into the airseal from a flowpath of the turbine engine. A gas turbine engine includes a rotating component and a stationary component located radially outboard of the rotating component. An airseal is located therebetween and includes a sealing surface and a mounting flange to secure the airseal to the stationary component. An airseal body extends between the sealing surface and the mounting flange and includes a cavity to absorb thermal energy transferred into the airseal.

17 Claims, 3 Drawing Sheets

(51) Int. Cl.

| | |
|---|---|
| ***F01D 11/12*** | (2006.01) |
| ***F01D 11/18*** | (2006.01) |
| ***F01D 11/24*** | (2006.01) |
| ***F04D 29/16*** | (2006.01) |
| ***F04D 29/32*** | (2006.01) |

(52) U.S. Cl.
CPC ..... *F01D 11/18* (2013.01); *F01D 11/24* (2013.01); *F04D 29/164* (2013.01); *F04D 29/321* (2013.01); *F05D 2220/32* (2013.01)

(56) References Cited

U.S. PATENT DOCUMENTS

| | | | | |
|---|---|---|---|---|
| 4,527,385 | A | 7/1985 | Jumele et al. | |
| 4,679,981 | A * | 7/1987 | Guibert | F01D 11/08 415/116 |
| 5,330,321 | A * | 7/1994 | Roberts | F01D 11/18 415/136 |
| 5,584,651 | A * | 12/1996 | Pietraszkiewicz | F01D 11/08 415/115 |
| 5,993,150 | A * | 11/1999 | Liotta | F01D 11/10 415/115 |
| 7,597,533 | B1 * | 10/2009 | Liang | F01D 9/02 415/116 |
| 7,665,962 | B1 * | 2/2010 | Liang | F01D 11/24 415/115 |
| 2011/0085900 | A1 * | 4/2011 | Schutz | F01D 9/06 415/202 |
| 2013/0170963 | A1 * | 7/2013 | Mironets | F01D 11/12 415/173.1 |

* cited by examiner

OUTER AIRSEAL FOR GAS TURBINE ENGINE

BACKGROUND

This disclosure relates to a gas turbine engine, and more particularly to gaspath leakage seals for gas turbine engines.

Gas turbine engines, such as those used to power modern commercial and military aircrafts, generally include a compressor section to pressurize an airflow, a combustor section for burning hydrocarbon fuel in the presence of the pressurized air, and a turbine section to extract energy from the resultant combustion gases. The airflow flows along a gaspath through the gas turbine engine.

The gas turbine engine includes a plurality of rotors arranged along an axis of rotation of the gas turbine engine. The rotors are positioned in a case, with the rotors and case having designed clearances between the case and tips of rotor blades of the rotors. It is desired to maintain the clearances within a selected range during operation of the gas turbine engine as deviation from the selected range can have a negative effect on gas turbine engine performance. The case typically includes an outer airseal located in the case opposite the rotor blade tip to aid in maintaining the clearances within the selected range. The outer airseals are mounted in the case, but often result in high heat transfer from the gaspath up into the flanges of the case. This results in faster case response than is often desirable, resulting in clearances outside of the selected range. Mass is often added to the case to slow the case response, but has limited effectiveness, and also increases the weight of the gas turbine engine.

SUMMARY

In one embodiment, an airseal for sealing between a rotating component and a stationary component of a turbine engine includes a sealing surface defining a spacing between the airseal and a rotating component of the turbine engine and a mounting flange to secure the airseal to a stationary component of the turbine engine. An airseal body extends between the sealing surface and the mounting flange. The airseal body includes a cavity configured to absorb thermal energy transferred into the airseal from a flowpath of the turbine engine.

Additionally or alternatively, in this or other embodiments the cavity extends circumferentially around a turbine engine axis.

Additionally or alternatively, in this or other embodiments the cavity has a cavity axial length greater than a cavity radial width.

Additionally or alternatively, in this or other embodiments a vent extends from the cavity through the airseal body and is configured to relieve air pressure in the cavity.

Additionally or alternatively, in this or other embodiments the airseal includes a first airseal portion including a first cavity portion and a second airseal portion including a second cavity portion. An attachment secures the first airseal portion to the second airseal portion.

Additionally or alternatively, in this or other embodiments the attachment is a braze or weld.

In another embodiment, a compressor assembly for a turbine engine includes a compressor rotor rotatable about a compressor axis, the compressor rotor including a compressor disc and a plurality of compressor blades extending radially outwardly from the compressor disc. A compressor case is located radially outboard of the compressor rotor. An airseal is positioned between the compressor case and the compressor blades and includes a sealing surface defining a spacing between the airseal and the plurality of rotor blades and a mounting flange to secure the airseal to the compressor case. An airseal body extends between the sealing surface and the mounting flange. The airseal body includes a cavity configured to absorb thermal energy transferred into the airseal from a flowpath of the turbine engine.

Additionally or alternatively, in this or other embodiments the cavity extends circumferentially around the compressor axis.

Additionally or alternatively, in this or other embodiments the cavity has a cavity axial length greater than a cavity radial width.

Additionally or alternatively, in this or other embodiments a vent extends from the cavity through the airseal body and is configured to relieve air pressure in the cavity.

Additionally or alternatively, in this or other embodiments the airseal includes a first airseal portion including a first cavity portion and a second airseal portion including a second cavity portion. An attachment secures the first airseal portion to the second airseal portion.

Additionally or alternatively, in this or other embodiments the attachment is a braze or weld.

In yet another embodiment, a gas turbine engine includes a rotating component and a stationary component located radially outboard of the rotating component. An airseal is located between the stationary component and the rotating component and includes a sealing surface defining a spacing between the airseal and the rotating component and a mounting flange to secure the airseal to the stationary component. An airseal body extends between the sealing surface and the mounting flange. The airseal body includes a cavity configured to absorb thermal energy transferred into the airseal from a flowpath of the gas turbine engine.

Additionally or alternatively, in this or other embodiments the cavity extends circumferentially around a gas turbine engine axis.

Additionally or alternatively, in this or other embodiments the cavity has a cavity axial length greater than a cavity radial width.

Additionally or alternatively, in this or other embodiments a vent extends from the cavity through the airseal body and is configured to relieve air pressure in the cavity.

Additionally or alternatively, in this or other embodiments the airseal includes a first airseal portion including a first cavity portion and a second airseal portion including a second cavity portion. An attachment secures the first airseal portion to the second airseal portion.

Additionally or alternatively, in this or other embodiments the attachment is a braze or weld.

Additionally or alternatively, in this or other embodiments the rotating component is a compressor rotor including a compressor disc and a plurality of compressor blades extending radially outwardly from the compressor disc, and the airseal is positioned between the stationary component and the compressor blades.

Additionally or alternatively, in this or other embodiments the mounting flange is configured to secure the airseal to a compressor case.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Figure 1:
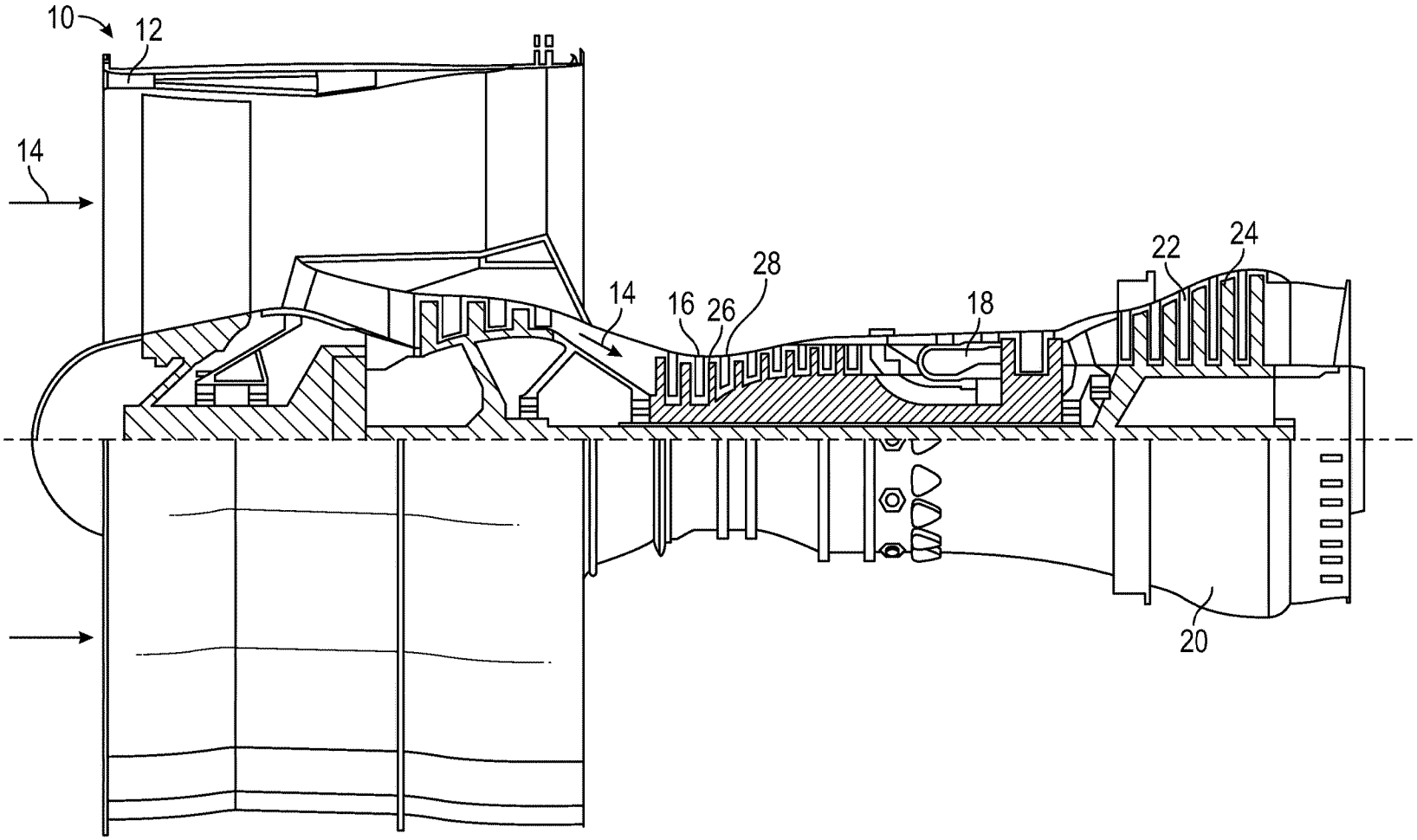
FIG. 1 illustrates a schematic cross-sectional view of an embodiment of a gas turbine engine.

FIG. 1 is a schematic illustration of a gas turbine engine 10. The gas turbine engine generally has a fan 12 through which ambient air is propelled in the direction of arrow 14, a compressor 16 for pressurizing the air received from the fan 12 and a combustor 18 wherein the compressed air is mixed with fuel and ignited for generating combustion gases.

The gas turbine engine 10 further comprises a turbine section 20 for extracting energy from the combustion gases. Fuel is injected into the combustor 18 of the gas turbine engine 10 for mixing with the compressed air from the compressor 16 and ignition of the resultant mixture. The fan 12, compressor 16, combustor 18, and turbine 20 are typically all concentric about a common central longitudinal axis of the gas turbine engine 10. In some embodiments, the turbine 20 includes one or more turbine stators 22 and one or more turbine rotors 24. Likewise, the compressor 16 includes one or more compressor rotors 26 and one or more compressor stators 28. It is to be appreciated that while description below relates to compressors 16 and compressor rotors 26, one skilled in the art will readily appreciate that the present disclosure may be utilized with respect to turbine rotors 24.

Figure 2:
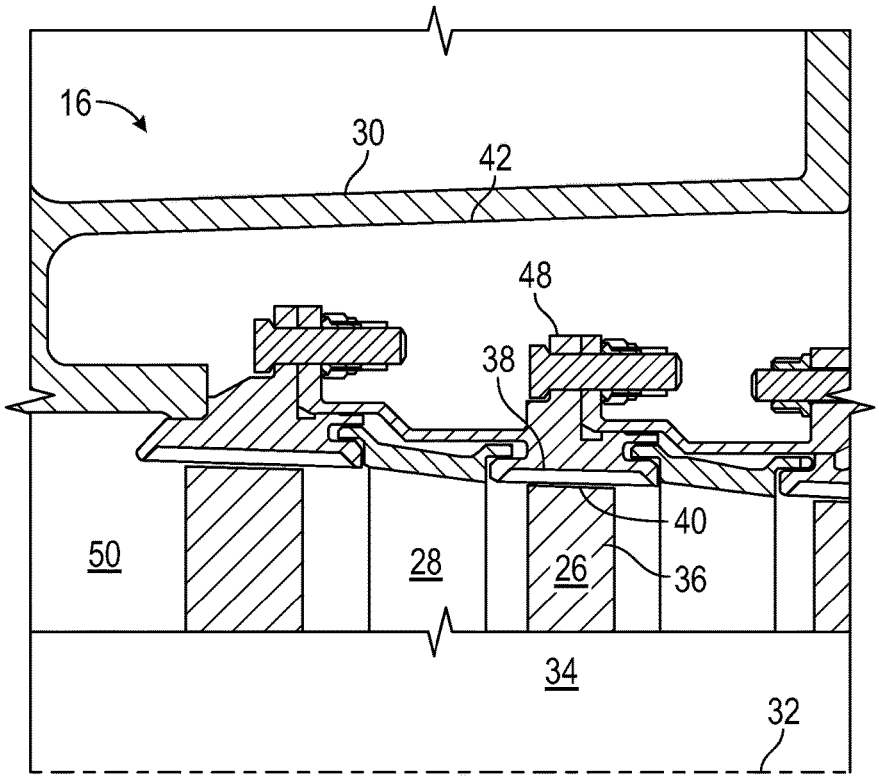
FIG. 2 illustrates a schematic cross-sectional view of an embodiment of a compressor of a gas turbine engine.

Referring now to FIG. 2, the compressor 16 includes a compressor case 30, in which the compressor rotors 26 are arranged along an engine axis 32 about which the compressor rotors 26 rotate. Each compressor rotor 26 includes a rotor disc 34 with a plurality of rotor blades 36 extending radially outwardly from the rotor disc 34. An outer airseal 38 is located in the compressor case 30 radially between a rotor blade tip 40 and an inner case surface 42. In some embodiments, the outer airseal 38 includes a rub strip 44 (see FIG. 3) configured to abrade in the event of contact with the rotor blade tip 40. The outer airseal 38 extends circumferentially around the compressor rotor 26, and may be a continuous ring or a plurality of outer airseal segments arranged in a ring. The outer airseal 38 extends circumferentially around the compressor rotor 26, and may be a continuous ring or a plurality of outer airseal segments arranged in a ring.

Figure 3:
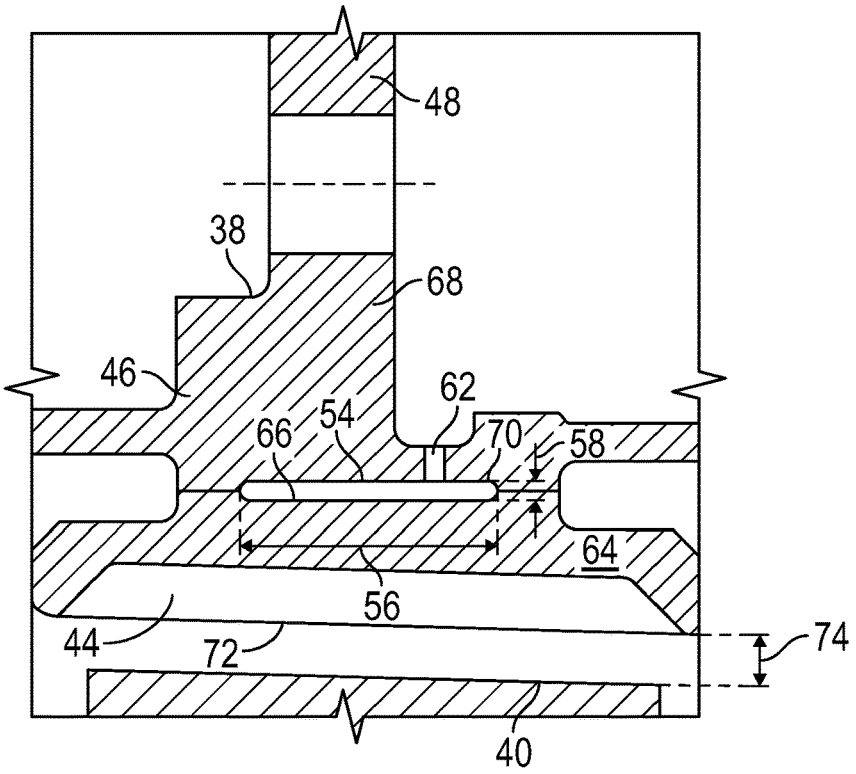
FIG. 3 illustrates an embodiment of an outer airseal for a gas turbine engine.

Referring now to FIG. 3, in some embodiments, the outer airseal 38 includes a rub strip 44 configured to abrade in the event of contact with the rotor blade tip 40. The outer airseal 38 includes an airseal body 46 supportive of the rub strip 44 at a sealing surface 72. The rub strip 44 and sealing surface 72 define a clearance 74 between the outer airseal 38 and the rotor blade tip 40. A mounting flange 48 positions the airseal 38 and secures the airseal 38 in the compressor case 30 via, for example, bolts or other fastening components (not shown). It is desired to control thermal energy transfer or conduction from a gaspath 50 (shown in FIG. 2) of the gas turbine engine 10 to the compressor case 30, since such thermal energy transfer has an effect on the clearance 74 between the rotor blade tip 40 and the outer airseal 38, which in turn has an effect on gas turbine engine 10 performance.

To slow or stop thermal energy transfer through outer airseal 38 to the compressor case 30, the outer airseal 38 includes a thermal cavity 54 positioned in the airseal body 46. The thermal cavity 54 is an opening at least semi enclosed in the airseal body 46 and extending circumferentially about the engine axis 32. The thermal cavity 54 has a cavity length 56 extending along a direction parallel to the engine axis 32 and a cavity width 58 extending in a radial direction. The thermal cavity 54 illustrated has an aspect ratio of cavity length 56 to cavity width 58 greater than one and has an oval-shaped cross-section. It is to be appreciated, however, that the thermal cavity may have other cross-sectional shapes such as, for example, circular, elliptical or irregular. Further, in some configurations the thermal cavity 54 may have a varying cross-sectional shape around the circumference of the engine 10.

The thermal cavity 54 acts to prevent or slow a flow of thermal energy from the gas path 50 through the outer airseal 38 to the compressor case 30. Thermal energy flowing through the outer airseal 38 is transferred to the air in the thermal cavity 54, thus reducing the thermal energy flow through the outer airseal 38. This thermal energy transfer increases a pressure of the air in the thermal cavity 54, thus one or more vents 62 are provided to allow airflow to escape the thermal cavity 54 to relieve the pressure in the thermal cavity 54. In some embodiments, the vent 62 is located at an outer surface of the airseal body 46 opposite the rub strip 44.

Figure 4:
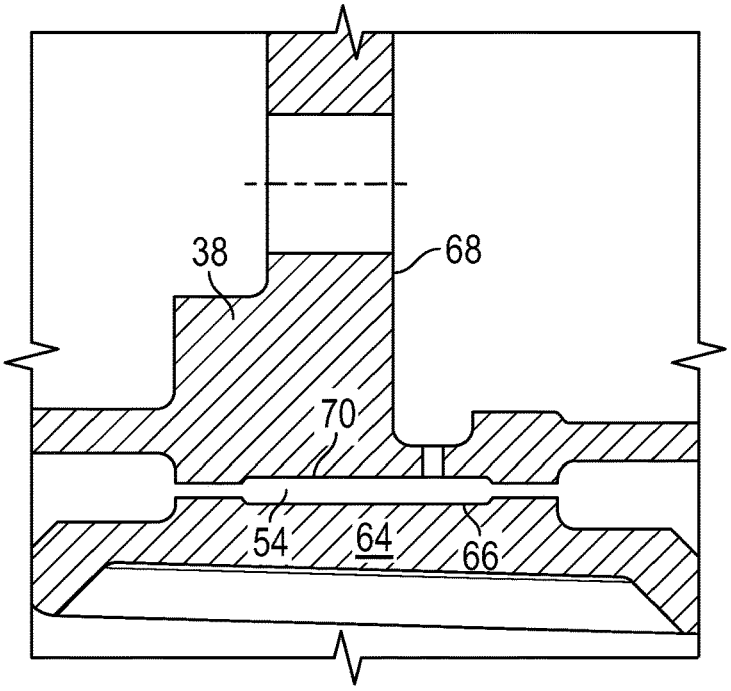
FIG. 4 illustrates another embodiment of an outer airseal for a gas turbine engine.

Referring now to FIG. 4, in some embodiments, the outer airseal 38, or outer airseal segment, is manufactured in two or more pieces, then joined together to produce the outer airseal 38 configuration with the thermal cavity 54. For example, a radially inboard airseal portion 64 of the outer airseal 38 is formed by, for example, machining, and includes a radially inboard cavity portion 66. A radially outboard airseal portion 68 is formed separately and includes a radially outboard cavity portion 70. The radially inboard airseal portion 64 and radially outboard airseal portion 68 are then joined by, for example, brazing or welding, into a single outer airseal 38 including the thermal cavity 54. It is to be appreciated that the outer airseal 38 may be fabricated in other ways, for example, by separately forming an axially upstream portion containing an axially upstream cavity portion and an axially downstream portion having an axially downstream cavity portion, then joining the two. Further, other technologies may be utilized in forming of the outer airseal 38, such as casting or additive manufacturing methods such as 3D printing.

The outer airseal 38 with thermal cavity 54 reduces the need to add mass to case flanges to slow thermal response of the case, thus reducing the mass of the case. Further, utilization of the outer airseal 38 reduces thermal gradients in the outer airseal 38 and in the compressor case 30, so low cycle fatigue life in the components is extended. Additionally, the outer airseal 38 with thermal cavity 54 reduces sensitivity to gaspath fluctuations or uncertainty during, for example, transient operation of the gas turbine engine 10.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. An airseal for sealing between a compressor rotor and a compressor case of a turbine engine, comprising:

a sealing surface defining a spacing between the airseal and a compressor rotor a of the turbine engine;

a mounting flange to secure the airseal to a compressor case of the turbine engine;

an airseal body extending between the sealing surface and the mounting flange, the airseal body including a cavity configured to absorb thermal energy transferred into the airseal from a flowpath of the turbine engine; and a vent extending from the cavity through the airseal body, configured to relieve air pressure in the cavity.

2. The airseal of claim 1, wherein the cavity extends circumferentially around a turbine engine axis.

3. The airseal of claim 1, wherein the cavity has a cavity axial length greater than a cavity radial width.

4. The airseal of claim 1, further comprising:

a first airseal portion including a first cavity portion;

a second airseal portion including a second cavity portion; and an attachment to secure the first airseal portion to the second airseal portion.

5. The airseal of claim 4, wherein the attachment is a braze or weld.

6. A compressor assembly for a turbine engine comprising:

a compressor rotor rotatable about a compressor axis, the compressor rotor including:

a compressor disc; and a plurality of compressor blades extending radially outwardly from the compressor disc;

a compressor case disposed radially outboard of the compressor rotor; and an airseal disposed between the compressor case and the compressor blades including:

a sealing surface defining a spacing between the airseal and the plurality of rotor blades;

a mounting flange to secure the airseal to the compressor case;

an airseal body extending between the sealing surface and the mounting flange, the airseal body including a cavity configured to absorb thermal energy transferred into the airseal from a flowpath of the turbine engine; and a vent extending from the cavity through the airseal body, configured to relieve air pressure in the cavity, the vent located at an outer surface of the airseal body opposite the sealing surface.

7. The compressor assembly of claim 6, wherein the cavity extends circumferentially around the compressor axis.

8. The compressor assembly of claim 6, wherein the cavity has a cavity axial length greater than a cavity radial width.

9. The compressor assembly of claim 6, further comprising:

a first airseal portion including a first cavity portion;

a second airseal portion including a second cavity portion; and an attachment to secure the first airseal portion to the second airseal portion.

10. The compressor assembly of claim 9, wherein the attachment is a braze or weld.

11. A gas turbine engine comprising:

a compressor rotor;

a compressor case disposed radially outboard of the compressor rotor ; and an airseal disposed between the compressor case and the compressor rotor including:

a sealing surface defining a spacing between the airseal and the compressor rotor;

a mounting flange to secure the airseal to the compressor case;

an airseal body extending between the sealing surface and the mounting flange, the airseal body including a cavity configured to absorb thermal energy transferred into the airseal from a flowpath of the gas turbine engine; and a vent extending from the cavity through the airseal body, configured to relieve air pressure in the cavity, the vent located at an outer surface of the airseal body opposite the sealing surface.

12. The gas turbine engine of claim 11, wherein the cavity extends circumferentially around a gas turbine engine axis.

13. The gas turbine engine of claim 11, wherein the cavity has a cavity axial length greater than a cavity radial width.

14. The gas turbine engine of claim 11, further comprising:

a first airseal portion including a first cavity portion;

a second airseal portion including a second cavity portion; and an attachment to secure the first airseal portion to the second airseal portion.

15. The gas turbine engine of claim 14, wherein the attachment is a braze or weld.

16. The gas turbine engine of claim 11, wherein the compressor rotor includes:

a compressor disc; and a plurality of compressor blades extending radially outwardly from the compressor disc;

wherein the airseal is disposed between the compressor case and the compressor blades.

17. The gas turbine engine of claim 11, wherein the mounting flange is configured to secure the airseal to the compressor case.

* * * * *